US007557675B2

(12) United States Patent
Guixa Arderiu

(10) Patent No.: US 7,557,675 B2
(45) Date of Patent: Jul. 7, 2009

(54) BROAD BAND MECHANICAL PHASE SHIFTER

(75) Inventor: Ramon Guixa Arderiu, Madrid (ES)

(73) Assignee: Radiacion Y Microondas, S.A., Madrid (ES)

( * ) Notice: Subject to any disclaimer, the term of this patent is extended or adjusted under 35 U.S.C. 154(b) by 523 days.

(21) Appl. No.: 10/569,687

(22) PCT Filed: Mar. 22, 2005

(86) PCT No.: PCT/SE2005/070033

§ 371 (c)(1),
(2), (4) Date: Feb. 27, 2006

(87) PCT Pub. No.: WO2006/051146

PCT Pub. Date: May 18, 2006

(65) Prior Publication Data

US 2008/0211600 A1 Sep. 4, 2008

(51) Int. Cl.
*H01P 1/18* (2006.01)

(52) U.S. Cl. ..... 333/156

(58) Field of Classification Search ..... 333/156, 333/161; 342/375

See application file for complete search history.

(56) References Cited

U.S. PATENT DOCUMENTS

| | | | |
|---|---|---|---|
| 2,041,600 | A | 5/1936 | Friis |
| 2,432,134 | A | 12/1947 | Bagnall |
| 2,540,696 | A | 2/1951 | Smith |
| 2,596,966 | A | 5/1952 | Lindsay |
| 2,648,000 | A | 8/1953 | White |
| 2,773,254 | A | 12/1956 | Engelmann |

(Continued)

FOREIGN PATENT DOCUMENTS

| | | | |
|---|---|---|---|
| AU | 38746/93 | A | 7/1993 |

(Continued)

OTHER PUBLICATIONS

Hansen, R.C., Fundamentals of Scanning Arrays, Phased Array Antennas, 1998. 219-220, John Wiley & Sons, Inc., New York.

(Continued)

*Primary Examiner*—Benny Lee
*Assistant Examiner*—Alan Wong
(74) *Attorney, Agent, or Firm*—Birch, Stewart, Kolasch & Birch, LLP

(57) ABSTRACT

Mechanical phase shifter which from an external feed signal obtains several signals out of phase with each other, each one of which is applied to an antenna of an array, so that the result of the interference of the radiated fields provides a radiation pattern. The object of the invention is to obtain a greater range of pointing angles, achieved by protrusions or screws that act as capacitors or short-circuits that allow suppressing the higher modes generated in the phase shifter, as well as preventing part of the mutual coupling between the phase shifter L-lines. In addition, due to the greater length of the L-lines, these are reinforced by a protrusion perpendicular to the greater length of the line located on the outer edge of each L-line, and in addition they are provided with supporting means for the L-lines which minimize the vibrations, sag and deformations. The L-lines also increase the frequency at which higher modes appear.

21 Claims, 8 Drawing Sheets

U.S. PATENT DOCUMENTS

| | | | |
|---|---|---|---|
| 2,831,169 | A | 4/1958 | Casal |
| 2,836,814 | A | 5/1958 | Nail |
| 2,913,686 | A | 11/1959 | Fubini et al. |
| 2,939,335 | A | 6/1960 | Braud et al. |
| 2,951,996 | A | 9/1960 | Pan |
| 2,968,808 | A | 1/1961 | Russell |
| 3,032,759 | A | 5/1962 | Ashby |
| 3,032,763 | A | 5/1962 | Sletten |
| 3,205,419 | A | 9/1965 | Voigt |
| 3,277,481 | A | 10/1966 | Robin et al. |
| 3,656,179 | A | 4/1972 | De Loach |
| 3,769,610 | A | 10/1973 | Savarin et al. |
| 3,916,349 | A | 10/1975 | Ranghelli et al. |
| 3,969,729 | A | 7/1976 | Nemit |
| 4,129,872 | A | 12/1978 | Toman |
| 4,160,976 | A | 7/1979 | Conroy |
| 4,176,354 | A | 11/1979 | Hsiao et al. |
| 4,241,352 | A | 12/1980 | Alspaugh et al. |
| 4,249,181 | A | 2/1981 | Lee |
| 4,348,676 | A | 9/1982 | Tom |
| 4,427,984 | A | 1/1984 | Anderson |
| 4,451,699 | A | 5/1984 | Gruenberg |
| 4,485,362 | A | 11/1984 | Campi et al. |
| 4,517,570 | A | 5/1985 | Gray, Jr. |
| 4,532,518 | A | 7/1985 | Gaglione et al. |
| 4,564,824 | A | 1/1986 | Boyd, Jr. |
| 4,575,697 | A | 3/1986 | Rao et al. |
| 4,602,227 | A | 7/1986 | Clark et al. |
| 4,633,203 | A | 12/1986 | Nowak |
| 4,636,755 | A | 1/1987 | Gibbs |
| 4,652,877 | A | 3/1987 | Gray |
| 4,714,930 | A | 12/1987 | Winter et al. |
| 4,717,918 | A | 1/1988 | Finken |
| 4,737,747 | A | 4/1988 | Henderson et al. |
| 4,768,001 | A | 8/1988 | Chan-Son-Lint et al. |
| 4,779,097 | A | 10/1988 | Morchin |
| 4,788,515 | A | 11/1988 | Wong et al. |
| 4,791,428 | A | 12/1988 | Anderson |
| 4,804,899 | A | 2/1989 | Wurdack et al. |
| 4,814,774 | A | 3/1989 | Herczfeld |
| 4,814,775 | A | 3/1989 | Raab et al. |
| 4,821,596 | A | 4/1989 | Eklund |
| 4,841,262 | A | 6/1989 | Lomangino |
| 4,881,082 | A | 11/1989 | Graziano |
| 4,968,956 | A | 11/1990 | Huang |
| 5,039,994 | A | 8/1991 | Wash et al. |
| 5,075,648 | A | 12/1991 | Roberts et al. |
| 5,162,803 | A | 11/1992 | Chen |
| 5,174,556 | A | 12/1992 | Taylor et al. |
| 5,181,042 | A | 1/1993 | Kaise et al. |
| 5,184,140 | A | 2/1993 | Hariu et al. |
| 5,210,542 | A | 5/1993 | Pett et al. |
| 5,214,364 | A | 5/1993 | Perdue et al. |
| 5,268,696 | A | 12/1993 | Buck et al. |
| 5,281,974 | A | 1/1994 | Kuramoto et al. |
| 5,343,173 | A | 8/1994 | Balodis et al. |
| 5,440,318 | A | 8/1995 | Butland et al. |
| 5,473,294 | A | 12/1995 | Mizzoni et al. |
| 5,488,737 | A | 1/1996 | Harbin et al. |
| 5,494,303 | A | 2/1996 | Darling |
| 5,494,370 | A | 2/1996 | Habicht et al. |
| 5,512,914 | A | 4/1996 | Hadzoglou et al. |
| 5,523,764 | A | 6/1996 | Martinez et al. |
| 5,551,060 | A | 8/1996 | Fujii et al. |
| 5,563,558 | A | 10/1996 | Mohwinkel et al. |
| 5,585,769 | A | 12/1996 | Mazzochette |
| 5,596,329 | A | 1/1997 | Searle et al. |
| 5,617,103 | A | 4/1997 | Koscica et al. |
| 5,659,886 | A | 8/1997 | Taira et al. |
| 5,661,494 | A | 8/1997 | Bondyopadhyay |
| 5,705,962 | A | 1/1998 | Fleeger et al. |
| 5,714,961 | A | 2/1998 | Kot et al. |
| 5,798,675 | A | 8/1998 | Drach |
| 5,798,734 | A | 8/1998 | Ohtsuka et al. |
| 5,801,600 | A | 9/1998 | Butland et al. |
| 5,805,996 | A | 9/1998 | Salmela |
| 5,818,385 | A | 10/1998 | Bartholomew |
| 5,832,365 | A | 11/1998 | Chen et al. |
| 5,861,848 | A | 1/1999 | Iwasaki |
| 5,905,462 | A | 5/1999 | Hampel et al. |
| 5,917,455 | A * | 6/1999 | Huynh et al. ..... 343/792.5 |
| 5,940,030 | A | 8/1999 | Hampel et al. |
| 5,949,303 | A | 9/1999 | Arvidsson et al. |
| 5,949,370 | A | 9/1999 | Smith et al. |
| 5,973,641 | A | 10/1999 | Smith et al. |
| 5,983,071 | A | 11/1999 | Gagnon et al. |
| 5,995,047 | A | 11/1999 | Freyssinier et al. |
| 5,995,062 | A | 11/1999 | Denney et al. |
| 6,005,522 | A | 12/1999 | Arias et al. |
| 6,069,529 | A | 5/2000 | Evans |
| 6,078,824 | A | 6/2000 | Sogo |
| 6,091,311 | A | 7/2000 | Waters |
| 6,097,267 | A | 8/2000 | Hampel |
| 6,118,379 | A | 9/2000 | Kodukula et al. |
| 6,128,471 | A | 10/2000 | Quelch et al. |
| 6,188,373 | B1 | 2/2001 | Martek |
| 6,198,458 | B1 | 3/2001 | Heinz et al. |
| 6,208,222 | B1 | 3/2001 | Sinsky |
| 6,219,002 | B1 | 4/2001 | Lim |
| 6,239,744 | B1 | 5/2001 | Singer et al. |
| 6,246,370 | B1 | 6/2001 | Wixforth |
| 6,278,410 | B1 | 8/2001 | Soliman et al. |
| 6,292,143 | B1 | 9/2001 | Romanofsky |
| 6,310,585 | B1 | 10/2001 | Marino |
| 6,333,683 | B1 | 12/2001 | Hampel |
| 6,339,407 | B1 | 1/2002 | Gabriel et al. |
| 6,346,924 | B1 | 2/2002 | Heinz et al. |
| 6,377,134 | B1 | 4/2002 | Takenaka |
| 6,388,631 | B1 | 5/2002 | Livingston et al. |
| 6,421,023 | B1 | 7/2002 | Phelan |
| 6,441,700 | B2 | 8/2002 | Xu |
| 6,441,785 | B1 | 8/2002 | Rosen et al. |
| 6,445,353 | B1 | 9/2002 | Weinbrenner |
| 6,504,450 | B2 | 1/2003 | Kim et al. |
| 6,573,875 | B2 | 6/2003 | Zimmerman et al. |
| 6,586,931 | B2 | 7/2003 | Taicher |
| 6,621,377 | B2 | 9/2003 | Osadchy et al. |
| 6,646,522 | B1 | 11/2003 | Kozyrev et al. |
| 6,667,714 | B1 | 12/2003 | Solondz |
| 6,734,829 | B1 | 5/2004 | Gottl |
| 6,756,779 | B2 | 6/2004 | Gleixner et al. |
| 6,756,939 | B2 | 6/2004 | Chen et al. |
| 6,788,165 | B2 | 9/2004 | Runyon |
| 6,816,668 | B2 | 11/2004 | McDonald et al. |
| 6,831,602 | B2 | 12/2004 | McKinzie, III et al. |
| 6,850,130 | B1 | 2/2005 | Gottl et al. |
| 6,864,837 | B2 | 3/2005 | Runyon et al. |
| 6,870,512 | B2 | 3/2005 | Yoneda et al. |
| 6,922,169 | B2 | 7/2005 | Moh'd Izzat et al. |
| 6,963,314 | B2 | 11/2005 | Webb et al. |
| 6,987,487 | B2 | 1/2006 | Zimmerman et al. |
| 7,170,466 | B2 | 1/2007 | Janoschka |
| 7,221,239 | B2 | 5/2007 | Runyon |
| 7,224,247 | B2 | 5/2007 | Dean |
| 7,233,217 | B2 | 6/2007 | Phillips et al. |
| 7,298,233 | B2 | 11/2007 | Zimmerman |
| 7,301,422 | B2 * | 11/2007 | Zimmerman et al. ..... 333/161 |
| 2002/0070900 | A1 | 6/2002 | Phelan |
| 2002/0089394 | A1 | 7/2002 | McDonald et al. |
| 2002/0113750 | A1 | 8/2002 | Heinz et al. |
| 2002/0126059 | A1 | 9/2002 | Zimmerman et al. |
| 2002/0135524 | A1 | 9/2002 | Zimmerman et al. |
| 2003/0076198 | A1 | 4/2003 | Phillips et al. |
| 2003/0109231 | A1 | 6/2003 | Marcus et al. |

| | | | |
|---|---|---|---|
| 2003/0137294 | A1 | 7/2003 | Gleixner et al. |
| 2004/0061653 | A1 | 4/2004 | Webb et al. |
| 2004/0090286 | A1 | 5/2004 | Runyon |
| 2004/0217908 | A1 | 11/2004 | Zigler et al. |
| 2005/0017822 | A1 | 1/2005 | Runyon |
| 2005/0046514 | A1 | 3/2005 | Janoschka |
| 2005/0179610 | A1 | 8/2005 | Le et al. |
| 2005/0219133 | A1 | 10/2005 | Elliot |
| 2006/0145784 | A1 | 7/2006 | Dean |
| 2006/0164185 | A1 | 7/2006 | Tae et al. |
| 2006/0273864 | A1 | 12/2006 | Zimmerman et al. |

FOREIGN PATENT DOCUMENTS

| | | | |
|---|---|---|---|
| AU | 664625 | | 1/1994 |
| AU | 764242 | | 3/2001 |
| BR | 0013376-0 | A | 5/2002 |
| CN | 1214484 | C | 8/2005 |
| DE | 24 58 477 | A1 | 7/1976 |
| DE | 3323234 | A1 | 1/1985 |
| DE | 199 38 862 | C1 | 3/2001 |
| EP | 0 137 562 | A2 | 4/1985 |
| EP | 0241153 | A2 | 10/1987 |
| EP | 0 357 165 | A2 | 3/1990 |
| EP | 0 398 637 | A2 | 11/1990 |
| EP | 0 423 512 | A2 | 4/1991 |
| EP | 0 540 387 | A2 | 5/1993 |
| EP | 0 588 179 | A1 | 3/1994 |
| EP | 0 593 822 | A1 | 4/1994 |
| EP | 0 595 726 | A1 | 5/1994 |
| EP | 0 618 639 | A2 | 10/1994 |
| EP | 0 616 741 | B1 | 11/1995 |
| EP | 1 054 466 | A2 | 11/2000 |
| EP | 1 067 626 | A2 | 1/2001 |
| EP | 1 082 781 | B1 | 3/2001 |
| EP | 1 194 982 | B1 | 4/2002 |
| EP | 1 208 614 | B1 | 5/2002 |
| EP | 1 239 534 | A2 | 9/2002 |
| EP | 1 239 535 | A2 | 9/2002 |
| EP | 1 239 538 | A2 | 9/2002 |
| ES | 2 174 613 | T3 | 11/2002 |
| ES | 2 204 679 | T3 | 5/2004 |
| ES | 2 228 561 | T3 | 4/2005 |
| ES | 2 204 679 | T4 | 6/2007 |
| FR | 2 581 255 | A1 | 10/1986 |
| GB | 817740 | | 8/1959 |
| GB | 1314693 | | 4/1973 |
| GB | 2035700 | A | 6/1980 |
| GB | 2158996 | A | 11/1985 |
| GB | 2159333 | A | 11/1985 |
| GB | 2171257 | A | 8/1986 |
| GB | 2171864 | A | 9/1986 |
| GB | 2196484 | A | 4/1988 |
| GB | 2232536 | A | 12/1990 |
| JP | 58-75901 | A | 5/1983 |
| JP | 61-234102 | A | 10/1986 |
| JP | 62-82801 | A | 4/1987 |
| JP | 1-120906 | U | 8/1989 |
| JP | 1-196804 | A | 8/1989 |
| JP | 1-268209 | A | 10/1989 |
| JP | 2-174302 | A | 7/1990 |
| JP | 2-174402 | A | 7/1990 |
| JP | 2-174403 | A | 7/1990 |
| JP | 2-121504 | U | 10/1990 |
| JP | 2-290306 | A | 11/1990 |
| JP | 03-286604 | A | 12/1991 |
| JP | 4-902 | A | 1/1992 |
| JP | 04-230105 | A | 8/1992 |
| JP | 4-286407 | A | 10/1992 |
| JP | 5-37222 | A | 2/1993 |
| JP | 5-121915 | A | 5/1993 |
| JP | 5-191129 | A | 7/1993 |
| JP | 6-196927 | A | 7/1994 |
| JP | 6-282801 | A | 10/1994 |
| JP | 6-326501 | A | 11/1994 |
| JP | 6-326502 | A | 11/1994 |
| JP | 7-183717 | A | 7/1995 |
| JP | 8-102601 | A | 4/1996 |
| JP | 8-265001 | A | 10/1996 |
| JP | 9-148801 | A | 6/1997 |
| JP | 9-214211 | A | 8/1997 |
| JP | 9-246845 | A | 9/1997 |
| JP | 9-246846 | A | 9/1997 |
| JP | 9-284031 | A | 10/1997 |
| JP | 10-13103 | A | 1/1998 |
| JP | 11-298212 | A | 10/1999 |
| JP | 11-355038 | A | 12/1999 |
| JP | 2000-196302 | A | 7/2000 |
| JP | 2001-196804 | A | 7/2001 |
| JP | 2002-33603 | A | 1/2002 |
| JP | 2002-151903 | A | 5/2002 |
| JP | 2002-151904 | A | 5/2002 |
| JP | 2003-507914 | A | 2/2003 |
| JP | 2006-77710 | A | 3/2006 |
| JP | 2006-325257 | A | 11/2006 |
| KR | 2002-0035574 | A | 5/2002 |
| KR | 10-0480226 | B1 | 4/2005 |
| WO | WO-88/08621 | A1 | 11/1988 |
| WO | WO-92/16061 | A1 | 9/1992 |
| WO | WO-93/12587 | A1 | 6/1993 |
| WO | WO-95/10862 | A1 | 4/1995 |
| WO | WO-96/14670 | A1 | 5/1996 |
| WO | WO-98/21779 | A1 | 5/1998 |
| WO | WO-01/13459 | A1 | 2/2001 |
| WO | WO-02/05383 | A1 | 1/2002 |
| WO | WO-03/019720 | A1 | 3/2003 |
| WO | WO-2004/082063 | A1 | 9/2004 |
| WO | WO-2006/051146 | A1 | 5/2006 |

OTHER PUBLICATIONS

Bacon, G.E., Variable-Elevation Beam-Aerial Systems For 1½ Metres, The Journal of The Institution of Electrical Engineers, Mar.-May 1946, 539-544, 93, 3.

Exner et al, On Existence of A Bound State in an L-Shaped Waveguide, Czech. J. Phys. S., 1989, 1181-1191.

Kother, Higher Order Modes on Usual Waveguides, International Journal of Infrared and Milllimeter Waves, 1987, 1365-1389, 8, 11, Dept of Electrical Engineering Duisburg University.

B. A. MYPMY>KEB, ISSN 0033-8486, PAΔNOTEXHNKA, 1984, No. 1, 71-72.

Li, et al., Microstrip Antenna Array Controlled with Active Phase Shifter, Journal of the Chinese Institute of Engineers, 1986, 9, 6, pp. 633-640, Dept of Electrical Engineering National Taiwan University, Taiwan.

Qing, et al., Circulary polarised circular ring slot antenna fed by stripline hybrid coupler, Electronic Letters, Dec. 9, 1999, 2154-2155, 35, 25.

Wu, et al., 2×2 Circulary Polarized Patch Antenna Arrays With Broadband Operation, Microwave and Optical Technology Letters, Dec. 5, 2003, 39, 5, Texas A&M University College Station, Texas.

* cited by examiner

BROAD BAND MECHANICAL PHASE SHIFTER

OBJECT OF THE INVENTION

The object of the present invention is a broad band mechanical phase shifter. One of the applications of phase shifters is to provide an electromechanical dynamic control of the beam radiated by an antenna array.

An antenna array consists of an assembly of N antennae, identical or otherwise, which radiate or receive simultaneously. The radiation pattern of the assembly is obtained as the interference of the fields radiated by each antenna, while for reception the signal is a linear combination of the signals captured by each antenna.

Phase shifters allow obtaining different pointing angles by feeding each antenna of the assembly with an electrical high-frequency signal with a different phase for each antenna.

The physical principle used is the electrical delay produced in the transmission lines to adjust the signal phase at the various feed points of the radiating elements of the array.

This invention characterises the special configuration and design of the phase shifter, which allows obtaining a greater range of variation of the pointing angle of the assembly of radiating elements with respect to the state of the art, such that the coverage area can be modified.

Another characteristic of the phase shifter object of the invention is that its configuration and design prevents vibrations, sag and the lack of rigidity of the striplines used in phase shifters in the state of the art.

Thus, the present invention lies within the field of electromechanical means used to achieve a dynamic control of the beam radiated by an antenna array, and more specifically phase shifters.

BACKGROUND OF THE INVENTION

As stated above, the purpose of phase shifters is to control the phase difference, using the physical principle of the electrical delay produced in transmission lines to adjust the signal phase. The electrical delay can be obtained by various methods, such as those mentioned below.

One of said methods, as described in patent JP5121902 A, published on 18 May 1993, consists of modifying the propagation velocity of the transmission line, so that the phase shifter comprises a mobile dielectric part interposed between two coaxial conductors. The relative movement of this dielectric part changes the relative phase between the two conductors. One of the drawbacks of such a system is the variation in the characteristic impedance as the dielectric moves.

Another method used to obtain an electrical delay is that described in patent JP5121915 A, published on 28 May 1993, where the phase shifter disclosed has a transmission line that is mobile with respect to a fixed transmission line. The mobile line is connected to the phase shifter feed and is coupled to the fixed line, so that when it moves, the signal phase on one end of the fixed line will change with respect to the other end.

A similar system is described in patent JP9246846 A published on 19 Sep. 1997. This invention describes a phase shifter having three transmission line segments with a stripline construction, a circular shape and staggered in a peripheral sense, a connection point being adjusted around a central point in contact with the corresponding line segment.

European Patent EP1208614 B1, published on 1 May 2004, describes a phase shifter improved with respect to previous ones having one input and four outputs for connecting four radiating elements by pairs. It is provided with two stripline segments arranged concentrically and one feed element common to the two segments placed radially, said common feed element being able to revolve about a central axis to allow modifying the relative differences of the signal phase between the ends of the stripline segments.

This system has several drawbacks. On one hand, if the striplines exceed a certain length, resonances appear due to excitation of higher modes, so that after this length the phase shifter no longer works properly.

This is, the limitation in the use of striplines after a certain length limits the range of variation of the pointing angle.

For example, at 2170 MHz in order to displace by 8 degrees the direction of radiation of the array, the inner stripline must have an approximate length of 45 mm and a curvature radius to allow construction of about 31 mm. In turn, for a low coupling between lines the radius of the outer stripline must be about 62 mm and its length about 90 mm. With these dimensions, the resonant frequency appears around 2335 MHz. This implies that the maximum mechanical angle between end positions of the phase shifter must be approximately 83 degrees. For greater angles the phase shifter would not work, as the resonant frequency would fall inside the band. FIG. 2 of patent EP1208614 B1 is thus only valid when the angle is smaller than 83 degrees, and FIG. 4 will only be valid for an even smaller angle given its obvious larger size.

Another disadvantage of the striplines of said invention is their low mechanical rigidity, more so if the dielectric used is air, as said striplines lack any support to minimise vibrations or sagging. This is an important factor, as vibrations, sagging or deformations of striplines can lead to losses or variations in the voltage standing wave ratio (VSWR).

Another drawback of current mechanical phase shifters is the impossibility of actuating several common feeds of different phase shifters, requiring control by a single actuator.

In addition, the matching of the input signal transmission line to a specific impedance is performed externally to the phase shifter with cable lengths of different characteristic impedance and/or with impedance matching circuits, which increases the cost and complexity of the assembly.

Therefore, the object of the present invention is to provide a broad band mechanical phase shifter that overcomes the aforementioned drawbacks and therefore:

- Provides a pointing angle range that is not so limited by the appearance of resonances because the L-lines may have a greater length than the striplines.

Allows the striplines to be replaced by L-lines to thereby have a sufficient mechanical rigidity, more so considering that it is desired to increase their length in order to obtain a greater range of the pointing angle.

- Allows the phase shifters object of the invention to be stacked such that all common feeds of the various phase shifters can be actuated simultaneously by acting jointly on their common rotation shaft.
- Allows, by the design and configuration of the phase shifter, an improved assembly and mounting on the antenna as well as the use of 50 ohm cable exclusively in the entire antenna, with the resulting cost reduction
- A reduction in costs and a simpler assembly of the antennae as relates to adjusting the impedance of the external input and output transmission lines of the phase shifter.

DESCRIPTION OF THE INVENTION

The mechanical phase shifter of the invention provides various pointing angles to an antenna formed by a group of radiating elements. The various pointing angles are the resulting of feeding an electrical high-frequency signal to the various radiating elements conforming the array with a different phase at each one.

For this purpose, the phase shifter is provided with one or more L-lines. The term "L-line" means a conductive line that has a generally L-shaped cross section, in contrast to prior art stripline that is a flat conductive strip. If there are several L-lines they will be arranged concentrically. In addition, it has a common feed element that runs above the L-lines.

The common feed element revolves about a central shaft on one of its ends, located near the centre of curvature of the L-lines.

As the common feed element runs along the L-lines, the relative differences of the signal phase at the ends of the L-lines are modified.

As the L-lines have a greater length than the striplines of state-of-the-art phase shifters and are supported at their ends and at the recess defined in the common feed element, in order to provide them with a greater mechanical rigidity, the L-lines have been reinforced with respect to the striplines by a design that prevents any deformations. In this sense, the L-lines have a protrusion perpendicular to the greater dimension of the line at its outer perimeter that gives them a greater rigidity and resistance to deformations, as said deformations could result in losses and or variations of the VSWR at the phase shifter input or create more resonances.

Replacing traditional striplines by L-lines allows providing said L-lines with a greater rigidity and stability compared to striplines. However, this change of shape varies the boundary conditions for the solutions of Maxwell's equations, so that the solutions for the electric field with these conditions are not obvious.

The design of the L-lines is such that, due to the characteristic electric field generated, it allows the resonances of higher modes to appear at much higher frequencies than those of the striplines. This is because the protrusion of the L-lines partly short-circuits the electric field corresponding to higher modes, which are not transverse electromagnetic (TEM) as the main mode, such that for these higher modes the cavity in which they propagate as in a waveguide is smaller and the resonant frequency therefore increases.

To increase the range of the pointing angle for the array of radiating elements, the phase shifter is provided with protrusions or elements such as screws that act as capacitors or short-circuits, suppressing the higher modes generated in the L-lines and preventing part of the mutual coupling between the lines.

All of the L-lines of the phase shifter have dimensions such that their characteristic impedance is around 50 ohm.

The external feed line is placed asymmetrically with respect to the perpendicular axis to the L-lines of the phase shifter.

In addition, the external transmission line that feeds the phase shifter has a characteristic impedance of around 50 ohm, so that it is connected to an internal impedance matching network to 50 ohm, around which are provided metal protrusions, screws or elements acting as capacitors or short-circuits, meant to suppress the higher modes generated by the asymmetrical excitation in the cavity formed by the phase shifter.

The internal impedance matching network, formed by a single metal part, is a much cheaper solution than creating a matching network with cable lengths of different characteristic impedance and/or impedance matching circuits allowing to use a single type of cable which simplifies assembling the antennae in the assembly lines, therefore reducing costs.

The signal phase shift is effected by moving the mobile end of the common feed element along the L-lines. The L-lines and the common feed element are connected by the capacitive coupling that takes place with the upper and lower part of the central conductor of the L-lines with the common feed. This common feed element is perpendicular to the L-lines and is connected at the end with the turn to the impedance matching network of the phase shifter.

In addition to its constructive characteristics, the phase shifter allows a stacked assembly of the phase shifters, adjacent phase shifters sharing a single ground plane that separates them, thereby saving a great amount of space and allowing a synchronised actuation of all the common feed elements of all the phase shifters, as they are connected by their shafts, allowing to actuate all of them jointly.

DESCRIPTION OF THE DRAWINGS

To complete the description being made and in order to aid a better understanding of its characteristics, the present descriptive memory is accompanied by a set of drawings where, for purposes of illustration and in a non-limiting sense, the most important details of the invention are represented.

PREFERRED EMBODIMENT OF THE INVENTION

In view of the aforementioned figures, a description is provided below of a preferred embodiment of the invention as well as an explanation of the drawings.

Figure 1:
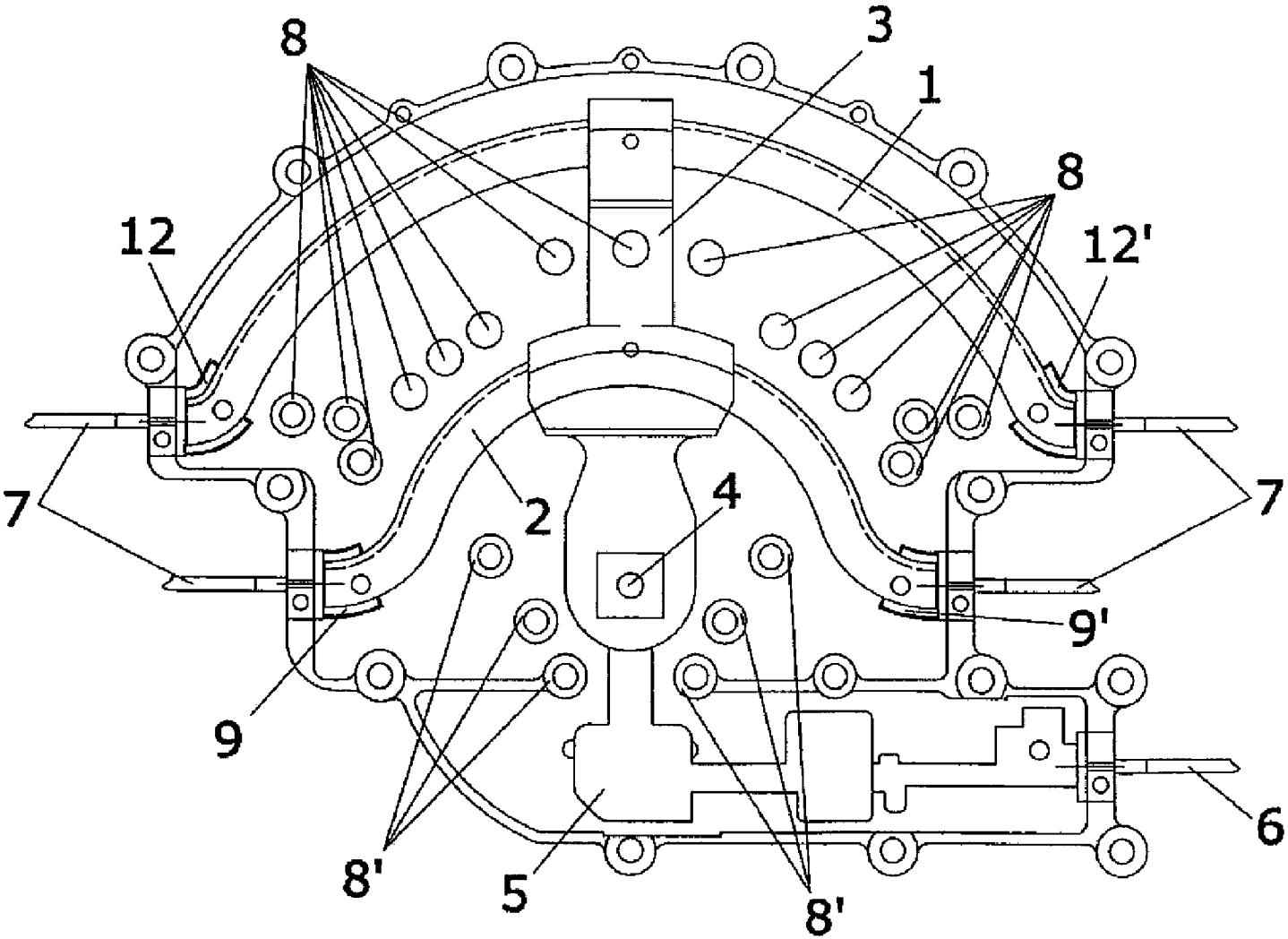
FIG. 1 shows a plan view of the interior of a specific embodiment for a phase shifter according to the object of the present invention.

FIG. 1 shows that the phase shifter is provided with an outer L-line (1) as well as another inner L-line (2) disposed concentrically about the previous one.

A capacitive coupling takes place on both L-lines (1) and (2) by means of a common feed element (3) that is placed perpendicular to both lines, which rotates about a shaft (4) placed on one of its ends.

To the phase shifter arrives an external transmission line (6) and four out-of-phase signal outputs (7) leave, each one connected to an end of an L-line (1) and (2).

The external feed transmission line input (6) is asymmetric with respect to the perpendicular axis of the L-line segments and is connected to an impedance matching network (5) constituted by a single metal piece, this network designed to maintain a low VSWR.

Disposed next to the impedance matching network (5) of the external transmission line (6) there are some protrusions (8') or screws that act as capacitors or short-circuits, which suppress the higher modes created by the asymmetrical excitation.

On another hand, to prevent the appearance of resonances the higher modes generated in the L-lines are suppressed by disposing on both ground planes of the phase shifter some protrusions (8) or screws that act as capacitors or short-circuits. Said protrusions (8) or short-circuits also insulate the L-line segment (1) from the L-line segment (2), preventing part of the mutual coupling between said L-lines.

The output transmission lines (7) have a characteristic impedance of about 50 ohms. The external transmission line (6) has this same characteristic impedance.

The phase shifter object of the invention allows the length of the L-lines of the mechanical phase shifter to be approximately 0.85λ, where λ is the wavelength of the nearest resonance frequency above the band of interest.

FIGS. 2*a*, 2*b*, 3*a* and 3*b* show the constructive characteristics of the elements used to support the L-lines at their ends.

Figure 2B:
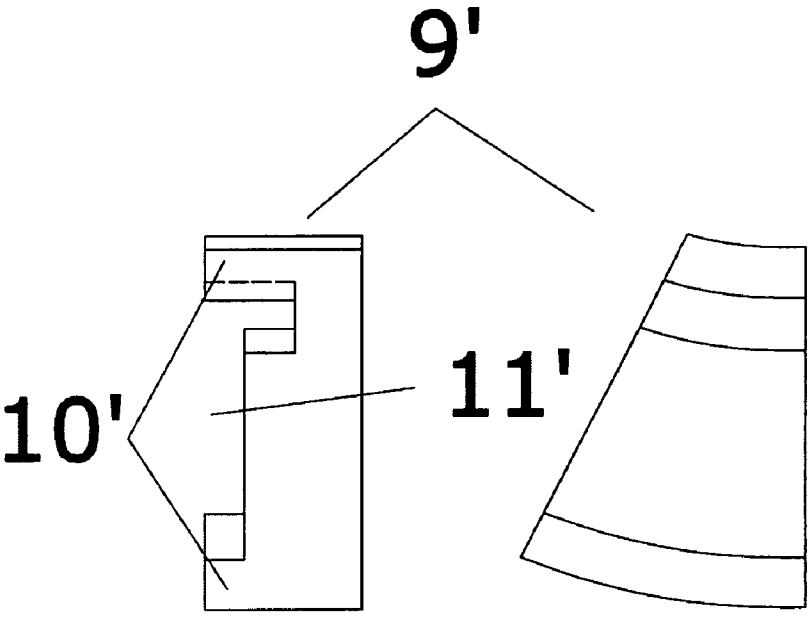
FIGS. 2*a* and 2*b* show the elements used to support the inner L-lines at their ends.
Figure 2A:
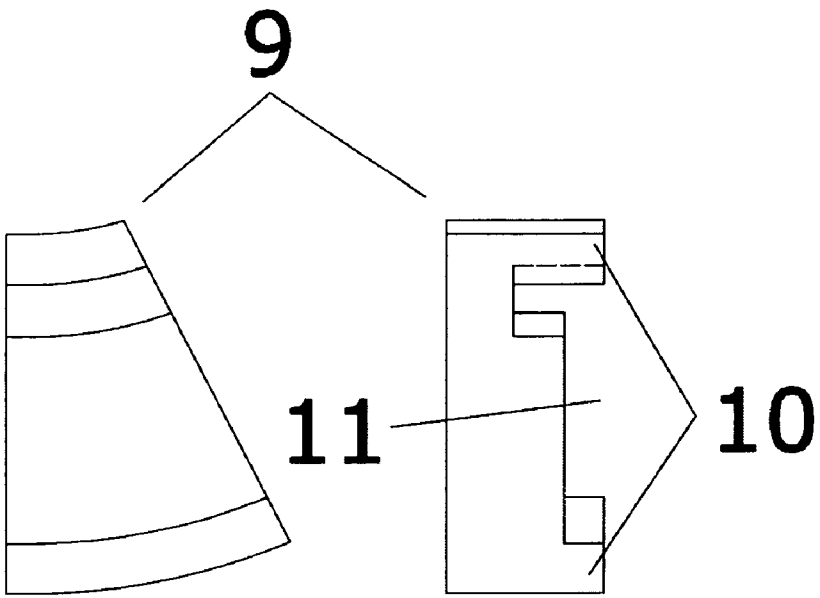

Specifically, in FIG. 2*a* one of the supports (9) of the inner L-line (2) is shown to have a shape that adapts to the shape of the inner L-line, and peripherally has protrusions (10) between which a recess (11) is defined with a width slightly greater than the width of the inner L-line (2). Similarly, FIG. 2*b* shows the other support (9') of the inner L-line (2), which can be seen to have a shape that adapts to that of the inner L-line and is peripherally provided with protrusions (10') between which a recess (11') is defined with a width slightly greater than the width of the inner L-line (2).

Figures 3A, 3B:
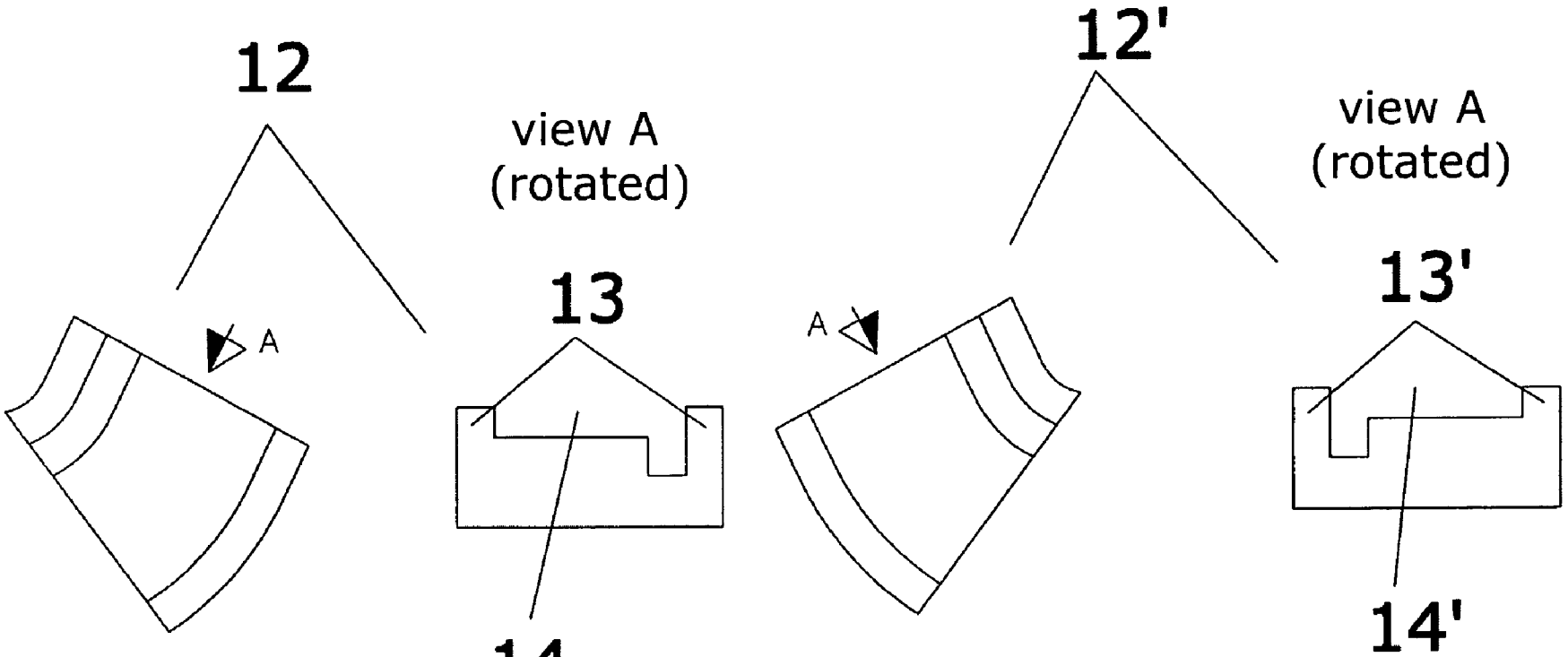
FIGS. 3*a* and 3*b* show the elements used to support the outer L-lines at their ends.

FIG. 3*a* shows one of the supports (12) of the outer L-line (1), having a shape that corresponds to that of said L-line; it is also provided with peripheral protrusions (13) between which is defined a recess (14) with dimensions slightly larger than the width of the outer L-line (1). Similarly, FIG. 3*b* shows the other support (12') of the outer L-line (1), with a shape that corresponds to that of the outer L-line, and is provided with peripheral protrusions (13') between which is defined a recess (14') with a width slightly larger than that of the outer L-line (1).

Figure 4:
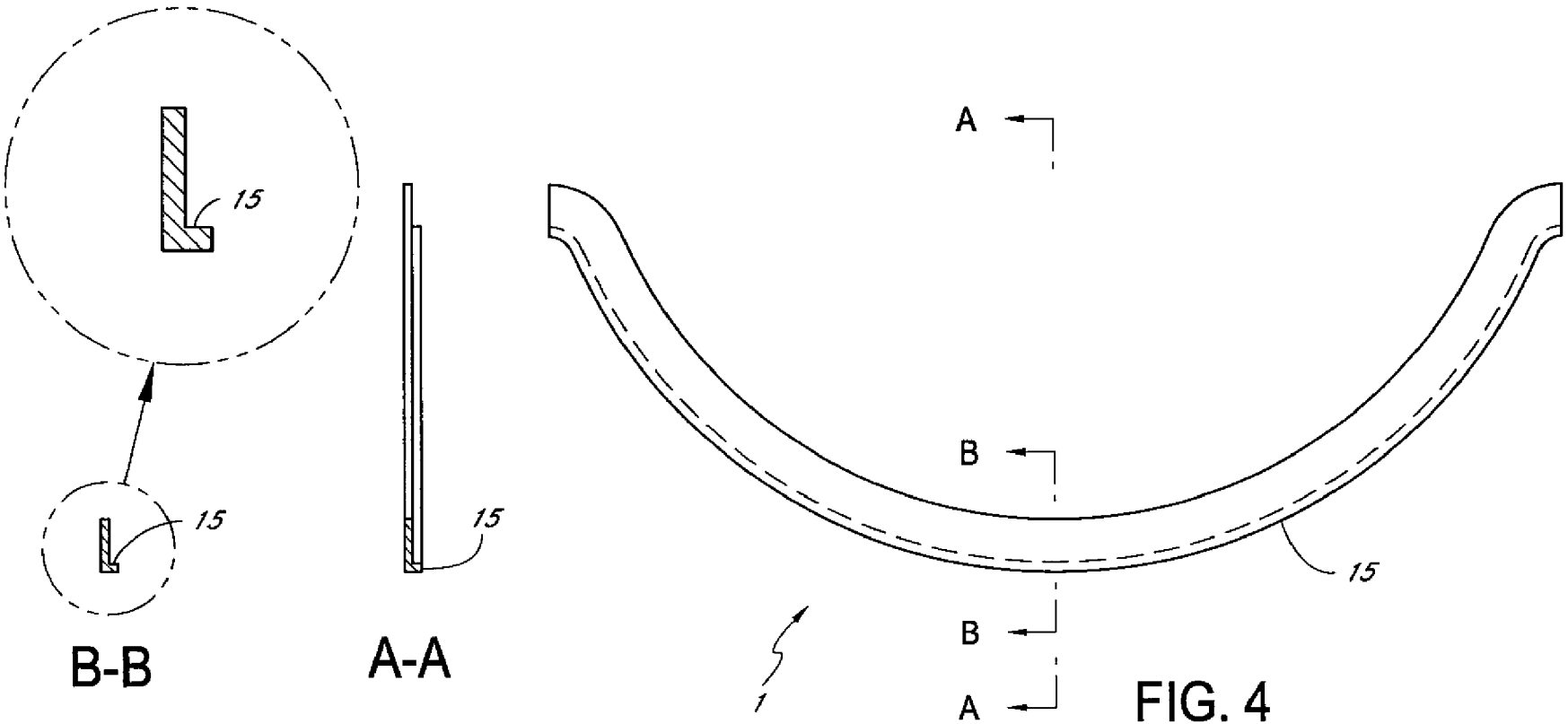
FIGS. 4 and 5 show a plan and side view of the shapes adopted by the outer and inner L-shaped section lines.
Figure 5:
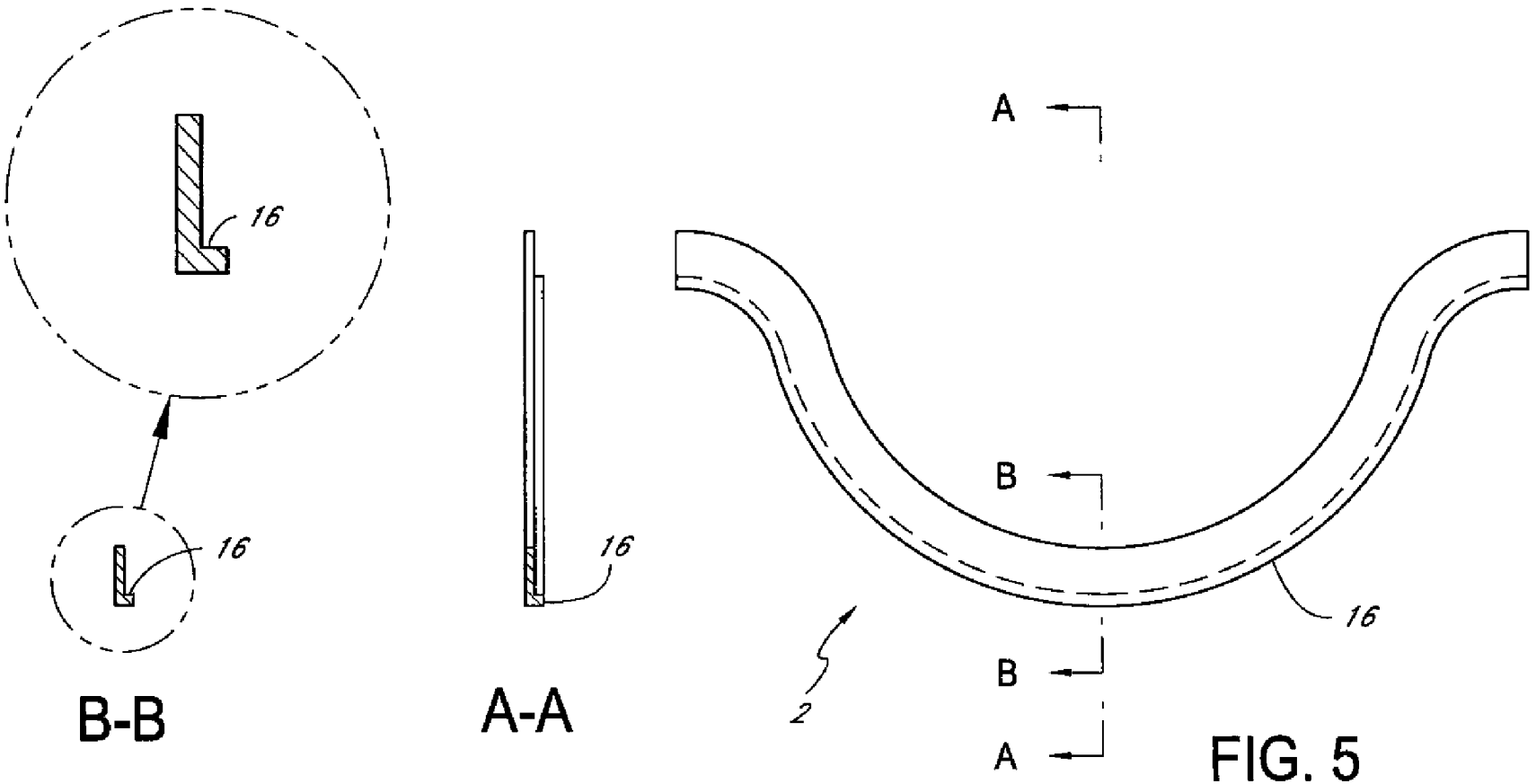

FIGS. 4 and 5 shows how the outer L-line (1) and the inner L-line (2) are provided on their outermost edge with a protrusion (15) and (16) respectively. These protrusions provide said L-lines (1) and (2) with a greater mechanical stability and rigidity allowing to minimise vibrations, sagging and deformations of said lines that may lead to losses or variations in the VSWR at the phase shifter input or cause resonances.

Due to the L-shaped configuration of said lines, at 2170 MHz with an outer L-line (1) length of approximately 105 mm, the nearest resonant frequency appears at 2350 MHz, so that the length of the L-lines could be even greater; thus, if the L-lines are longer a greater number of different pointing angles may be obtained, i.e. phase shifts, increasing the pointing range to achieve angles greater than 10°.

Figure 6:
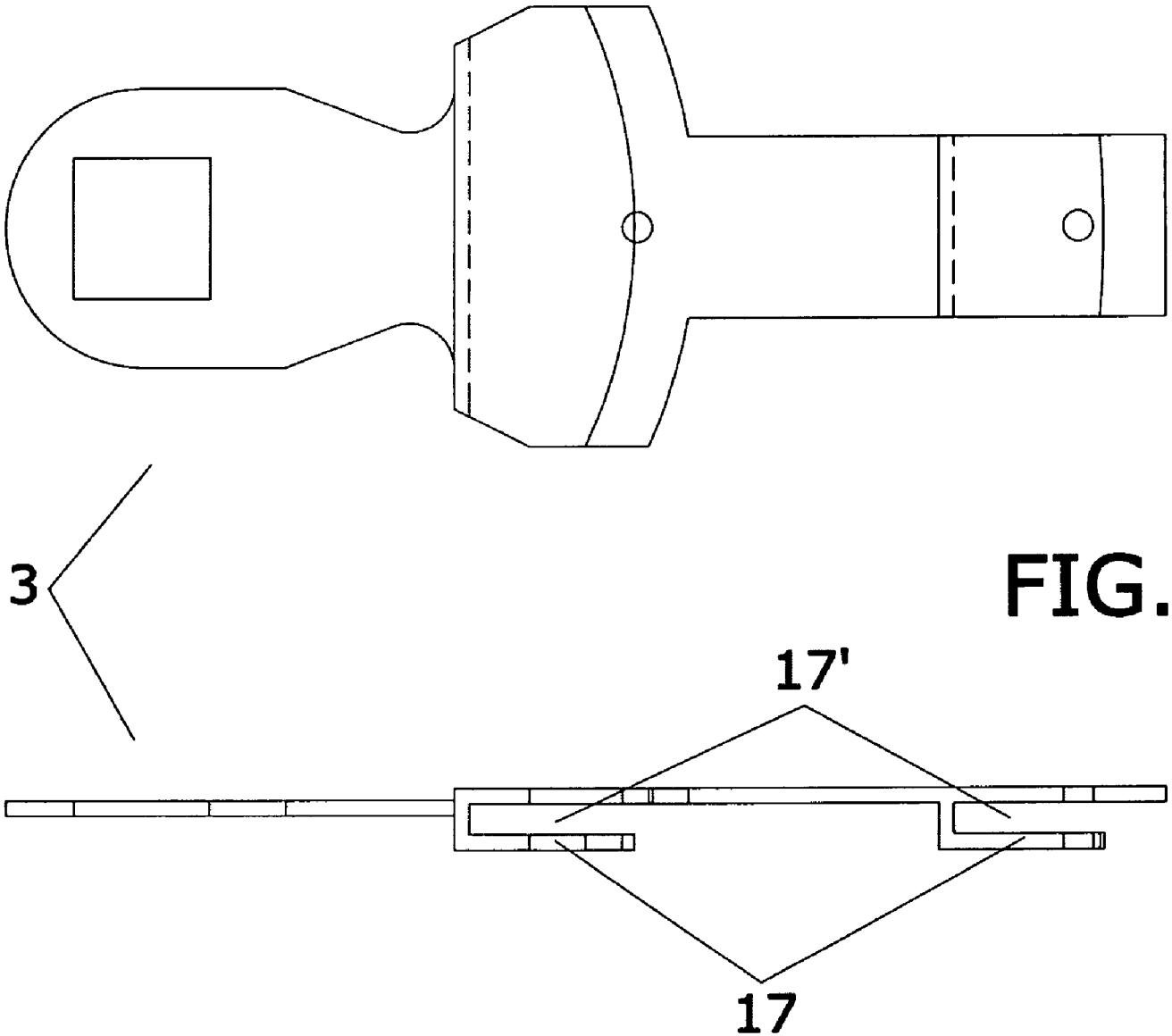
FIG. 6 shows a plan and side view of the constructive characteristics of the common feed.

FIG. 6 shows the constructive characteristics of the common feed element (3) under which emerge corresponding arms (17) that run parallel to the common feed element, defining recesses (17') that house a dielectric inside which run the L-lines.

The signal phase shift is effected by moving the mobile end of the common feed element (3) along the L-lines (1) and (2), and the connection between the L-lines and the common feed element is provided by the capacitive coupling produced by the upper and lower parts of the central conductor of the L-lines (1) and (2) with the common feed (3), this common feed element being perpendicular to the L-lines and connected at the end about which it turns to the impedance matching network (5) of the phase shifter.

Figure 7:
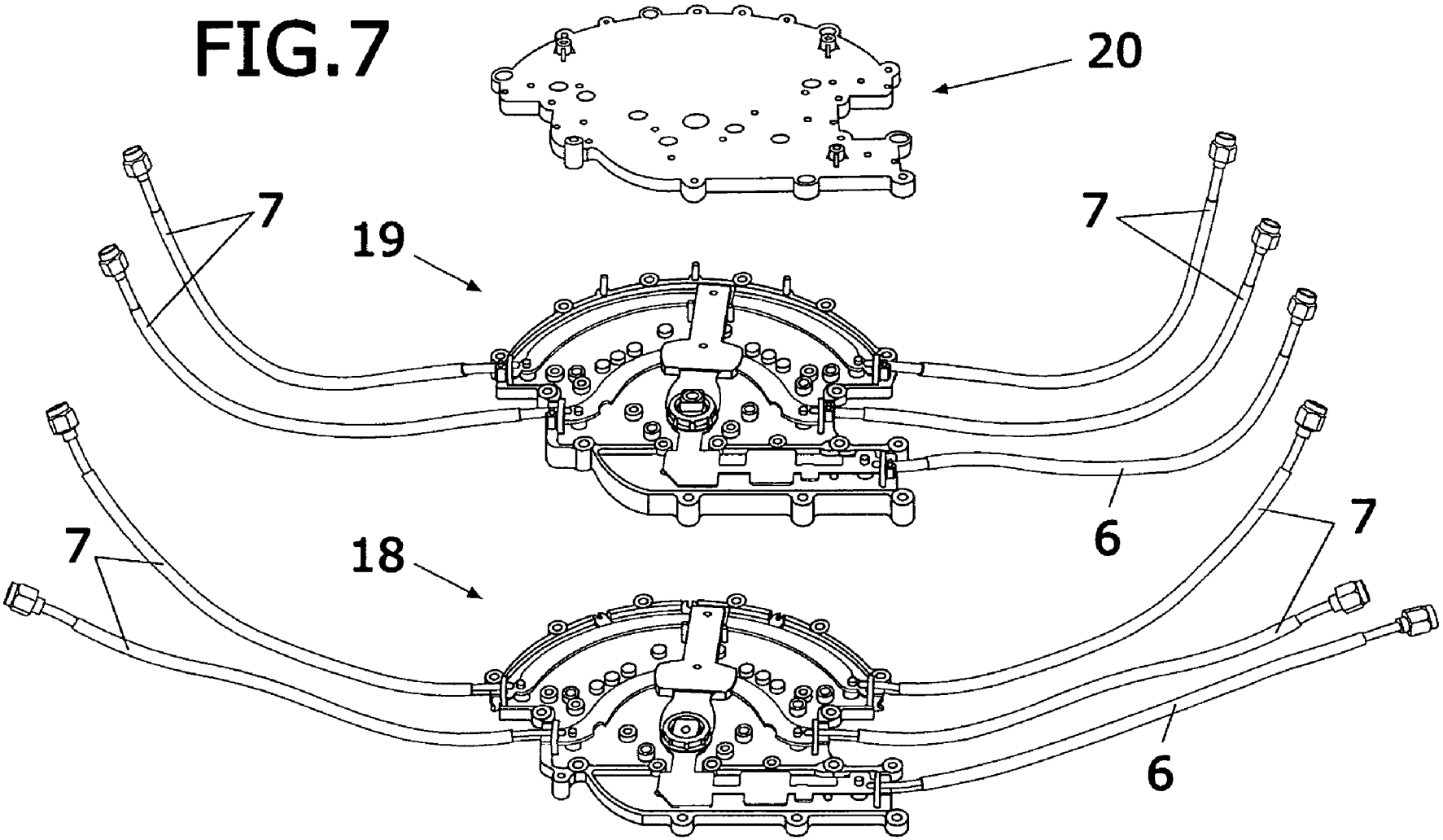
FIG. 7 shows an exploded view of the stacked assembly of some phase shifters, allowing to see that the common feed element of each phase shifter is actuated jointly through the common shaft of the common feed elements.

FIG. 7, which is an exploded view of the stacked arrangement of various phase shifters, shows a lower phase shifter (18) with its L-lines and its corresponding common feed element, followed above it by an intermediate phase shifter (19) in a stacked arrangement such that these adjacent phase shifters share a single ground plane which separates them, and finally a closure lid (20).

The number of intermediate phase shifters (19) can be as many as desired, sharing a single ground plane which separates them. Each phase shifter is provided with an external input line (6) and a number of signal outputs (7) that is double the number of L-line segments. Each phase shifter has its common feed element (3) and all are joined by their shaft (4), so that all common feed elements (3) can be actuated jointly and synchronously, the simultaneous actuation of several phase shifters being a clear advantage.

Figure 8:
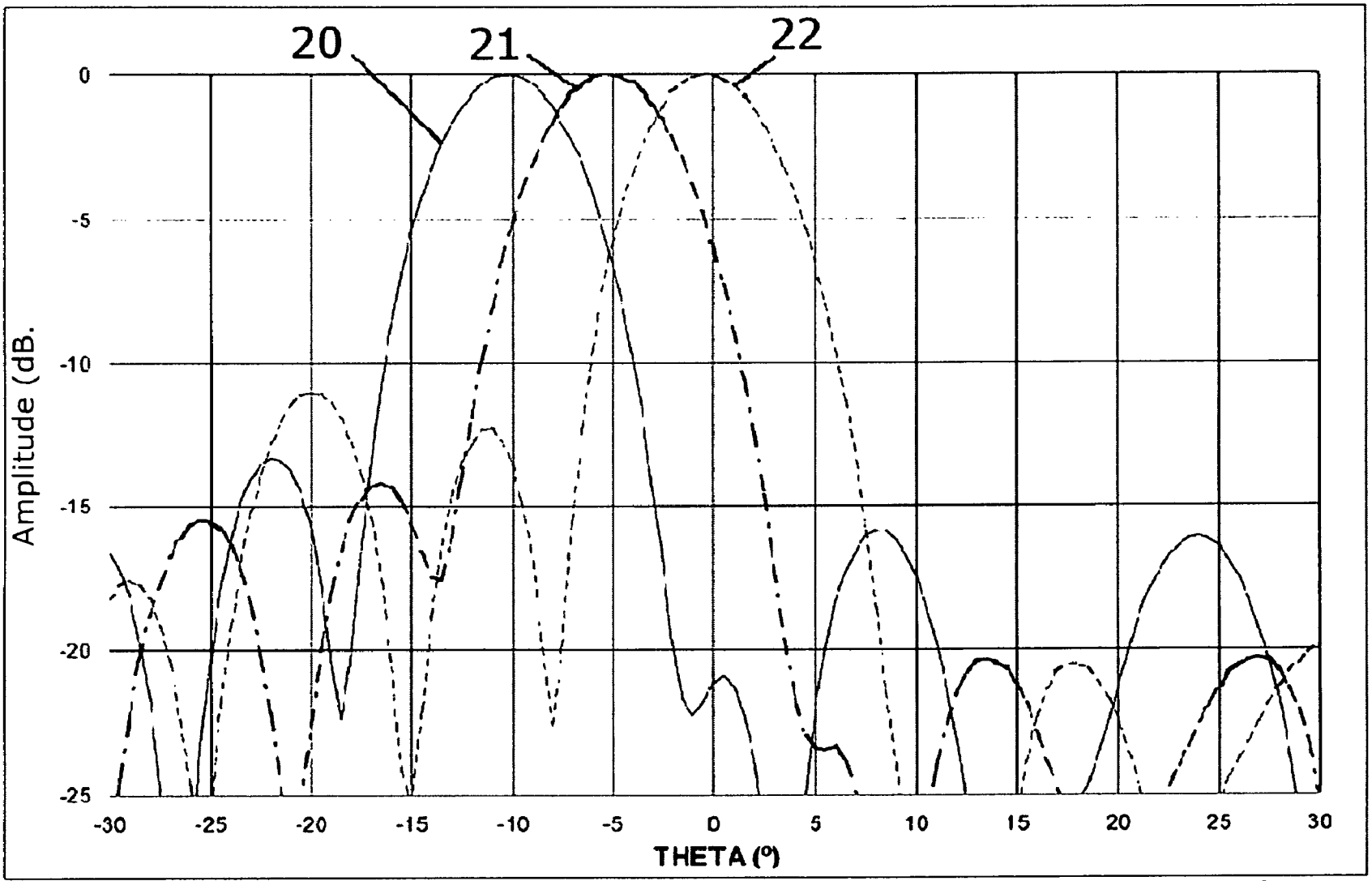
FIG. 8 shows a graph representing the pointing angle range for a specific embodiment of the invention.

FIG. 8 shows the range of variation of the pointing angle for a specific embodiment of the invention, showing the maximum range obtained (21) and (23) as well as an intermediate one (22), revealing that the mechanical phase shifter object of the invention, due to its constructive characteristics, can provide a variation range of the pointing angle even greater than 10°, line (21).

It is not considered necessary to extend this description for any expert in the field to understand the scope of the invention and the advantages derived thereof.

The materials, shape, size and arrangement of the component elements may vary as long as the essence of the invention is not affected.

The terms used in this memory must be understood in a broad and non-limiting sense.

The invention claimed is:

1. A broad band mechanical phase shifter, among those used to obtain a dynamic control by electromechanical means of the beam radiated by an antenna array, achieving various pointing angles, having:

one or several concentric lines;

a common feed element that runs along the lines ranged radially with respect to said lines;

transmission lines connected to the ends of each line, on which signals out of phase to each other are transmitted;

an external transmission line that feeds the phase shifter; and the broad band mechanical phase shifter comprises:

the concentric lines used have an L-shaped cross section, so that they have a protrusion perpendicular to the greater length of the line on its external perimeter;

the phase shifter is provided with protrusions or elements that act as capacitors or short- circuits, suppressing the higher modes generated in the L-shaped cross section lines and partly preventing the mutual coupling between said L-shaped cross section lines, in order to increase the range of variation of the pointing angle for the antenna array; and the L-shaped cross section lines are supported by their ends and on the recess defined in the common feed element.

2. The broad band mechanical phase shifter according to claim 1, wherein all L-shaped cross section lines have dimensions such that their characteristic impedance is close to 50 ohms.

3. The broad band mechanical phase shifter according to claim 2, wherein the phase shifter allows the length of the L-shaped cross section lines included in the mechanical phase shifter to be approximately equal to 0.85λ, where λ is the wavelength of the nearest resonant frequency above the band of interest.

4. The broad band mechanical phase shifter according to claim 2, wherein it allows a stacked arrangement of several phase shifters, the assembly having a bottom phase shifter, as many intermediate phase shifters as desired stacked on each other, adjacent phase shifters sharing a single ground plane that separates them, and a final closure lid, the L-shaped cross section lines of each phase shifter being capacitively connected to a common feed element for said lines, all the common feed elements of each phase shifter being joined by their rotation shaft so that they are actuated jointly and simultaneously by a single actuator.

5. The broad band mechanical phase shifter according to claim 1, wherein the external feed line is placed asymmetrically with respect to the axis perpendicular to the phase shifter L-shaped cross section lines and is connected to an internal impedance matching network, formed by a single metal part that makes the impedance of the phase shifter at its input be close to 50 ohms and maintain a low VSWR.

6. The broad band mechanical phase shifter according to claim 5, wherein round the internal impedance matching network are disposed some metallic protrusions, screws or elements acting as capacitors or short-circuits meant to suppress the higher modes generated by the asymmetrical excitation in the cavity formed by the phase shifter.

7. The broad band mechanical phase shifter according to claim 6, wherein the phase shifter allows the length of the L-shaped cross section lines included in the mechanical phase shifter to be approximately equal to 0.85λ, where λ is the wavelength of the nearest resonant frequency above the band of interest.

8. The broad band mechanical phase shifter according to claim 6, wherein it allows a stacked arrangement of several phase shifters, the assembly having a bottom phase shifter, as many intermediate phase shifters as desired stacked on each other, adjacent phase shifters sharing a single ground plane that separates them, and a final closure lid, the L-shaped cross section lines of each phase shifter being capacitively connected to a common feed element for said lines, all the common feed elements of each phase shifter being joined by their rotation shaft so that they are actuated jointly and simultaneously by a single actuator.

9. The broad band mechanical phase shifter according to claim 5, wherein the phase shifter allows the length of the L-shaped cross section lines included in the mechanical phase shifter to be approximately equal to 0.85λ, where λ is the wavelength of the newest resonant frequency above the band of interest.

10. The broad band mechanical phase shifter according to claim 5, wherein it allows a stacked arrangement of several phase shifters, the assembly having a bottom phase shifter, as many intermediate phase shifters as desired stacked on each other, adjacent phase shifters sharing a single ground plane that separates them, and a final closure lid, the L-shaped cross section lines of each phase shifter being capacitively connected to a common feed element for said lines, all the common feed elements of each phase shifter being joined by their rotation shaft so that they are actuated jointly and simultaneously by a single actuator.

11. The broad band mechanical phase shifter according to claim 1, wherein the common feed element is provided on its lower face wit arms that run parallel to the common feed element, defining recesses that house a dielectric in which the L-shaped cross section lines run.

12. The broad band mechanical phase shifter according to claim 11, wherein the phase shifter allows the length of the L-shaped cross section lines included in the mechanical phase shifter to be approximately equal to 0.85λ, where λ is the wavelength of the nearest resonant frequency above the band of interest.

13. The broad band mechanical phase shifter according to claim 1, wherein under the L-shaped cross section lines are disposed line supports having a shape that conforms to the L-shaped cross section lines, and in that they are peripherally provided with protrusions between which a recess is defined having a width slightly larger than the width of the L-shaped cross section line that it supports.

14. The broad band mechanical phase shifter according to claim 13, wherein the phase shifter allows the length of the L-shaped cross section lines included in the mechanical phase shifter to be approximately equal to 0.85λ, where λ is the wavelength of the nearest resonant frequency above the band of interest.

15. The broad band mechanical phase shifter according to claim 1, wherein the phase shifter allows the length of the L-shaped cross section lines included in the mechanical phase shifter to be approximately equal to 0.85λ, where λ is the wavelength of the nearest resonant frequency above the band of interest.

16. The broad band mechanical phase shifter according to claim 1, wherein it allows a stacked arrangement of several phase shifters, the assembly having a bottom phase shifter, as many intermediate phase shifters as desired stacked on each other, adjacent phase shifters sharing a single ground plane that separates them, and a final closure lid, the L-shaped cross section lines of each phase shifter being capacitively connected to a common feed element for said lines, all the common feed elements of each phase shifter being joined by their rotation shaft so that they are actuated jointly and simultaneously by a single actuator.

17. The broad band mechanical phase shifter according to claim 16, wherein each phase shifter is provided with one or several L-shaped cross section lines which are connected at their ends to transmission lines, which in turn are connected to radiating elements, each phase shifter also having an external feed line.

18. The broad band mechanical phase shifter according to claim 17, wherein the external feed line of each phase shifter is connected to an internal impedance matching network in each phase shifter.

19. The broad band mechanical phase shifter according to claim 18, wherein said impedance matching networks consist of a single metal piece in each phase shifter.

20. The broad band mechanical phase shifter according to claim 1, wherein due to the design of the L-shaped cross section lines the resonances of higher modes appear at much higher frequencies.

21. A radio-frequency phase shifter for coupling to a feed line, comprising:

at least first and second L-lines which are arranged concentrically, said at least first and second L-lines for coupling to at least two different pairs of antenna radiating elements in an antenna array fed with different phase angles at mutually offset connection locations;

a plurality of protrusions or elements for suppressing the higher modes generated in the L-lines and partly preventing the mutual coupling between said L-lines, in order to increase the range of variation of the pointing angle for the at least two different pairs of antenna radiating elements in the antenna array;

a common feed element pivotable about a central shaft, the common feed element having a first coupling section for said first L-line and having a second coupling section for said second L-line, said first and second coupling sections being respectively movable over the associated first and second L-lines and being coupled thereto; and at least first and second connection portions of the common feed element such that the feed line is electrically connected via the first and second connection portions to the first and second coupling sections associated wit said first and second L-lines, wherein the feed element is configured as an angle pointing element which revolves about the central shaft, and wherein the second connection portion is disposed with respect to the second L-line by extending the first connection portion which leads to the first coupling section.

* * * * *